United States Patent [19]

Kage

[11] Patent Number: 4,837,821

[45] Date of Patent: Jun. 6, 1989

[54] SIGNAL TRANSMISSION SYSTEM HAVING ENCODER/DECODER WITHOUT FRAME SYNCHRONIZATION SIGNAL

[75] Inventor: Kouzou Kage, Tokyo, Japan

[73] Assignee: NEC Corporation, Tokyo, Japan

[21] Appl. No.: 568,312

[22] Filed: Jan. 4, 1984

[30] Foreign Application Priority Data

Jan. 10, 1983 [JP] Japan ..... 58-1040

[51] Int. Cl.[4] ..... H04K 1/00

[52] U.S. Cl. ..... 380/9; 380/48; 380/49

[58] Field of Search ..... 455/26; 375/27, 17; 178/22.12; 179/1.55; 380/6, 8, 9, 28, 41, 48, 49, 50

[56] References Cited

U.S. PATENT DOCUMENTS

| | | | |
|---|---|---|---|
| 3,609,552 | 9/1971 | Limb et al. | 375/27 |
| 3,666,890 | 5/1972 | Wade | 375/27 |
| 3,784,743 | 1/1974 | Schroeder | 178/22.12 |
| 3,829,779 | 8/1974 | Fujimoto | 375/27 |
| 4,092,596 | 5/1978 | Dickinson et al. | 375/17 |
| 4,179,659 | 12/1979 | Tashiro | 375/27 |
| 4,283,602 | 8/1981 | Adams et al. | 380/41 |
| 4,346,473 | 8/1982 | Davis | 375/17 |
| 4,483,012 | 11/1984 | Wei | 375/27 |
| 4,591,673 | 5/1986 | Lee et al. | 380/48 |
| 4,608,456 | 8/1986 | Paik et al. | 179/1.5 S |
| 4,750,205 | 6/1988 | Lee et al. | 380/9 |
| 4,752,953 | 6/1988 | Paik et al. | 380/9 |

*Primary Examiner*—Salvatore Cangialosi

*Attorney, Agent, or Firm*—Sughrue, Mion, Zinn, Macpeak & Seas

[57] ABSTRACT

A privacy code-type signal transmission system includes a transmitter having a signal sampler for producing analog samples of an analog audio signal, an analog to digital converter, a scrambler, a multi-level analog former and modulator means. The analog to digital converter converts each analog sample into a parallel n bit digital signal. The parallel n bit digital signal is scrambled by a digital scrambler to produce a second parallel n bit digital signal. The second n bit digital signal is input to a multi-level former having $2^n$ different levels, the output of which is a $2^n$ level analog signal which is suitably modulated for transmission to a receiver. The receiver demodulates the $2^n$ level analog signal and with a level discriminator converts the demodulated signal to a scrambled digital signal corresponding to the scrambled digital signal produced at the transmitter. The original analog audio signal is then recovered by descrambling the digital signal and applying the descrambled digital signal to a digital to analog converter. This system eliminates any need for parallel-serial and serial-parallel converters, as well as frame sync insertion and extraction circuits necessary in conventional privacy code-type transmission systems.

12 Claims, 1 Drawing Sheet

SIGNAL TRANSMISSION SYSTEM HAVING ENCODER/DECODER WITHOUT FRAME SYNCHRONIZATION SIGNAL

BACKGROUND OF THE INVENTION

The present invention relates to a signal transmission system and, more particularly, to a secret or privacy signal transmission system.

Privacy signal transmission systems heretofore proposed may generally be classified into two types, i.e., a spectrum inversion type and a type which allows messages to be exchanged using digitally processed privacy codes (e.g. key codes or PN codes). The spectrum inversion type system is not a perfect privacy implementation, however, since it, inherently allows sound volumes to be identified and even part of the voice to be overheard from which the content of the communication can be reconstructed. In addition, conversations can leak between common channels when there is common channel interference in a radio system with independent receivers of the same type.

The privacy code type system, on the other hand, is free from the possibility of eavesdropping or leak, since conversations are exchanged between only specific individuals which share common privacy codes (e.g. key codes or PN codes). Nevertheless, this system has disadvantages in transmission efficiency and in circuit structure. At a transmitting terminal of the system in question, an audio signal such as voice is quantized to provide a parallel digital signal train. This parallel signal train is scrambled with a key or PN code for privacy, converted into a serial digital signal train, and transmitted to a receiving terminal. At the receiving terminal, the transmitted serial signal train is converted into a parallel digital signal train which is descrambled with the key or PN code. The descrambled digital signal is converted into an analog audio signal.

As can be seen from the foregoing, the privacy code type system inevitably needs a parallel-to-serial (P/S) and a serial-to-parallel (S/P) converters. To convert the serial digital signal train into the parallel one, the receiving terminal also requires frame sync signals. Inserting the frame sync signals into the audio digital signal train degrades the transmission efficiency and requires an inserting circuit for the sync signal at the transmitting terminal and an extracting circuit for the sync signal at the receiving terminal. The P/S and S/P converters and the inserting and extracting circuits make the whole circuit structure complex.

SUMMARY OF THE INVENTION

It is therefore an object of the present invention to provide a signal transmission system which eliminates a P/S and S/P converters and frame sync inserting and extracting circuits.

It is another object of the present invention to provide a signal transmission system which samples an audio analog signal to provide an n-bit digital signal, converts it into a multi-level signal and then transmits it without a frame sync signal.

It is still another object of the present invention to provide a signal transmission system which eliminates the need for the frame sync signal by converting the multi-level signal into an n-bit digital signal and further converting it into an analog signal.

It is another object of the present invention to provide a secret signal transmission system having no frame sync signal.

A signal transmission system of the present invention has a transmitting station which includes an encoder for sampling an analog signal or a difference signal representing the difference between an analog audio signal and a comparison signal and converting it into a digital audio signal, which is represented by n bits ($n \geqq 2$) for one sampling. The digital audio signal is processed by a multi-level former into a signal having $2^n$ different levels and this signal is transmitted after modulation. At a receiving terminal, the $2^n$-level signal is demodulated and converted by a level discriminator into the digital audio signal. The digital audio signal is applied to a decoder to reproduce an analog audio signal.

The system of the present invention requires no frame sync signal and, thereby, enables audio information to be transmitted with 100% efficiency, which offers the reproduced audio signal with desirable quality. Provision of parallel-to-serial and serial-to-parallel converters is needless and, in addition, the receiving terminal does not require a frame sync signal reproducing circuit since it needs a clock signal only. This, not to speak of simple construction, facilitates completion of the synchronizing system. In short, the system according to the present invention achieves improvements both in performance and in economy.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENT

Figure 1:
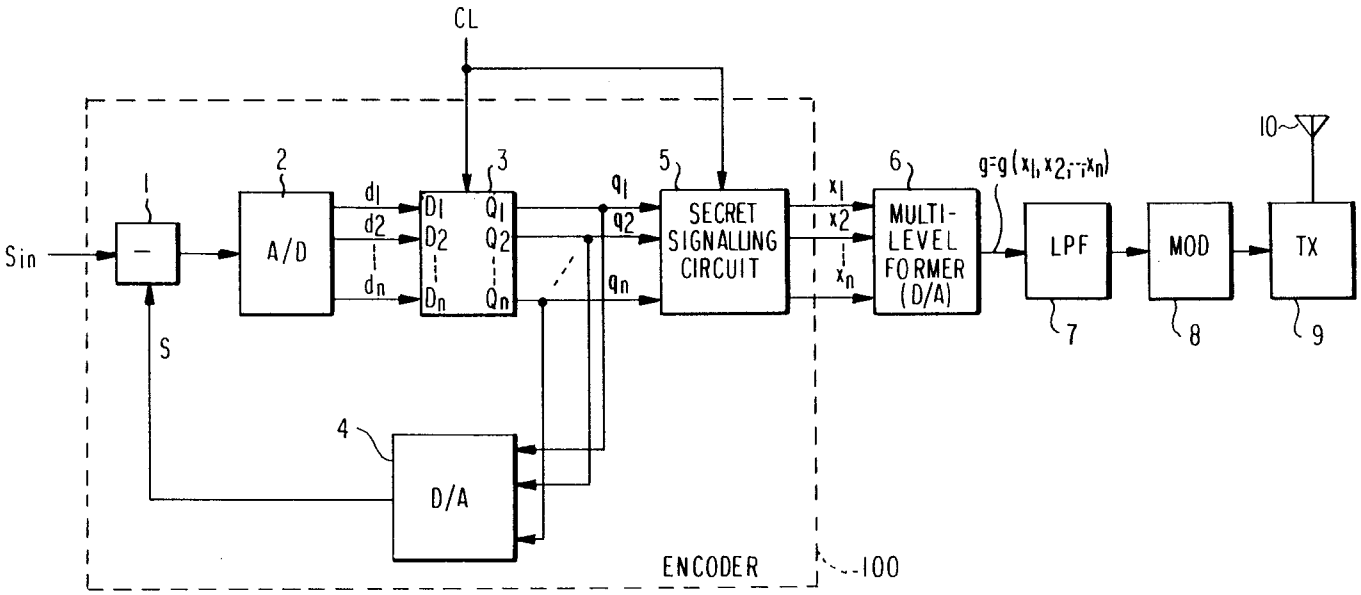
FIG. 1 is a block diagram showing a transmitting terminal in a signal transmission system in accordance with the present invention.

Referring to FIG. 1, the reference numeral 100 designates an encoder which is a differential pulse code modulation (DPCM) type encoder used in this particular embodiment. The encoder 100 includes a subtractor 1 adapted to extract a difference between an input analog audio signal $S_{in}$ and a comparison signal S, which will be described. The output of the subtractor 1 is converted by an analog-to-digital (A/D) converter 2 into a parallel n-bit digital signal $d_1, d_2, \ldots, d_n$, where n is an integer and equal to or greater than 2. The digital n-bit output is individually applied to a latch circuit 3 to be thereby latched in response to a clock signal CL, which is also supplied to a secret-signalling circuit 5. The latch 3 may comprise a flip-flop, for example. The latched outputs $q_1, q_2, \ldots, q_n$ are converted into analog signals by a digital-to-analog (D/A) converter 4, to produce the comparison signal S. The signal S is used to presume an input signal $S_{in}$ based on the digital signals $q_1, q_2, \ldots, q_n$ and, concerning the waveform it resembles the signal $S_{in}$ very much.

The digital signals $q_1, q_2, \ldots, q_n$ are applied to the secret-signalling circuit 5 which then scrambles all or part of the digital signals to produce output signals $x_1, x_2, \ldots, x_n$. The secret-signalling in the circuit 5 may be realized, for example, by applying a pseudo-random noise (PN) signal from a PN generator to all or any of the signal trains $q_1$–$q_n$ by way of Exclusive-OR gates. An example of such a secret-signalling circuit (or scrambler) is disclosed in U.S. Pat. No. 3,784,743 issued Jan. 8, 1974 to H. C. Schroeder. In this manner, the digital audio signals $x_1, x_2, \ldots, x_n$ from the encoder 100 respectively have random values due to the secrecy processing.

A multi-level former 6 receives the digital audio signals $x_1, x_2, \ldots, x_n$ and converts them into corresponding levels. In practice, the multi-level former comprises a D/A converter which produces $2^n$ different levels in response to n-bit input data. The output of the multi-level former 6 is restricted in frequency band by a low pass filter 7, modulated by a modulator 8, and then sent out by a transmitter 9 through an antenna 10. Depending upon the conditions of the propagation path, the modulator may comprise any one of an FM modulator, a PM modulator, an AM modulator and like modulators.

Figure 2:
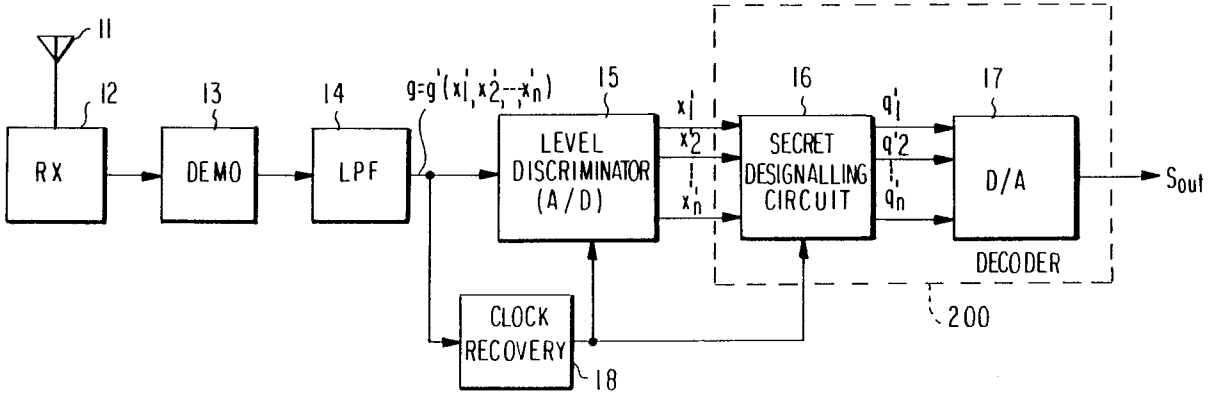
FIG. 2 is a block diagram showing a receiving terminal in a signal transmission system in accordance with the present invention.

Referring to FIG. 2, the signal picked up by an antenna 11 and received by a receiver 12 is demodulated by a demodulator 13 and then applied to a level discriminator 15 via a low pass filter 14. The level discriminator 15 discriminates the $2^n$ different levels out of the received signal and delivers signals $x'_1, x'_2, \ldots, x'_n$ corresponding to the signals $x_1, x_2, \ldots, x_n$ formed at the transmitter in the parallel mode. A practical element constituting the level discriminator 15 is an A/D converter. The output signals $x'_1, x'_2, \ldots, x'n$ of the level discriminator 15 are fed to a demodulator 200.

The demodulator 200 includes a secret-designalling (or descrambler) circuit 16 which deciphers the inputs to produce signals $q'_1, q'_2, \ldots, q'_n$ matching with the signals $q_1, q_2, \ldots, q_n$ which were prepared at the transmitting terminal. A D/A converter 17 processes the outputs of the secret-designalling circuit into analog audio signals $S_{out}$. The secret-designalling circuit 16 functions in the opposite manner to the secret-signalling circuit 5 (FIG. 1). That is, it may employ a descrambler disclosed in the Patent to Schroeder. The D/A converter 17 may comprise one which is equivalent to the D/A converter 4 installed in the transmitting terminal. A clock recovery circuit 18 at the receiving terminal serves to extract and recover a clock signal out of the output of the low pass filter 14 in order to operate the level discriminator 15 and secret-designalling circuit 16 therewith.

The signal transmission system according to the present invention has no P/S and S/P digital converters and therefore requires no frame sync signal. In addition, the system has a high transmission efficiency because there is no frame sync signal and the multi-level analog signal can have information capacity per time higher than the n-bit serial digital signal.

It will be apparent to those skilled in this art that the DPCM type encoder used in the above-described embodiment may be replaced by a pulse code modulation (PCM) type encoder.

What is claimed is:

1. A signal transmitter comprising:

first converter means for converting an analog audio signal into a first parallel digital signal;

second converter means responsive to a clock signal for scrambling said first parallel digital signal to provide a second parallel digital signal;

multi-level former means for converting said second parallel digital signal into a multi-level analog signal; and means for transmitting said multi-level analog signal.

2. A transmitter as claimed in claim 1 in which said transmitting means comprises means for modulating a carrier wave with said multi-level analog signal, and means for transmitting the modulated carrier wave.

3. A transmitter as claimed in claim 1 in which said first parallel digital signal is a first n-bit digital signal, n being an integer and equal to or greater than 2; said second parallel digital signal is a second n-bit digital signal; and said multi-level analog signal is a $2^n$-level analog signal.

4. A transmitter as claimed in claim 1 in which said first converter means comprises subtractor means for providing a difference signal between said analog audio signal and a comparison signal, analog-to-digital converter means for converting said difference signal into said first parallel digital signal, latch circuit means for latching said first parallel digital signal in synchronism with said clock signal, and digital-to-analog converter means for converting the output of said latch circuit means into an analog signal and supplying the converted analog signal to said subtractor means as said comparison signal; and said second converter means comprises means responsive to said clock signal for scrambling the output of said latch circuit means to provide said second parallel digital signal.

5. A signal receiver comprising:

means for receiving a multi-level analog signal;

means for recovering a clock signal from the received multi-level analog signal;

level-discriminator means responsive to said clock signal for converting said received multi-level analog signal into a first parallel digital signal;

first converter means responsive to said clock signal for descrambling said first parallel digital signal to provide a second parallel digital signal; and second converter means for converting said second parallel digital signal into an analog audio signal.

6. A receiver as claimed in claim 5 in which said receiving means comprises means for receiving a carrier wave modulated with said multi-level analog signal; and means for demodulating said carrier wave to provide said multi-level analog signal.

7. A receiver as claimed in claim 5 in which said multi-level analog signal is a $2^n$-level signal, n being an integer and equal to or greater than 2; said first parallel digital signal is a first n-bit digital signal; and said second parallel digital signal is a second n-bit digital signal.

8. A receiver as claimed in claim 5 in which said level-discriminator means comprises analog-to-digital converter means for converting said received multi-level analog signal into said first parallel digital signal in synchronism with said clock signal; and said first converter means comprises means responsive to said clock signal for scrambling said first parallel digital signal to provide said second parallel digital signal.

9. A signal transmission system including a transmitting terminal and a receiving terminal, wherein:

said transmitting terminal comprises first converter means for converting an incoming analog audio signal into a first parallel digital signal, second converter means responsive to a first clock signal for scrambling said first parallel digital signal to provide a second parallel digital signal, multi-level former means for converting said second parallel digital signal into a multi-level analog signal, and means for transmitting said multi-level analog signal and wherein:

said receiving terminal comprises means for receiving the transmitted multi-level analog signal means for recovering from the received multi-level analog signal a second clock signal which corresponds to said first clock signal, level-discriminator means responsive to said second clock signal for converting said received multi-level analog signal into a third parallel digital signal, third converter means for responsive to said second clock signal for scrambling said third parallel digital signal to provide a fourth parallel digital signal, and fourth converter means for converting said fourth parallel digital signal into an outgoing analog audio signal.

10. A signal transmission system as claimed in claim 9 in which said transmitting means comprises means for modulating a carrier wave with said multi-level analog signal, and means for transmitting the modulated carrier wave; and said receiving means comprises means for receiving the transmitted carrier wave, and means for demodulating the received carrier wave to provide said received multi-level analog signal.

11. A signal transmission system as claimed in claim 9 in which said first parallel digital signal is a first n-bit digital signal, n being an integer and equal to or greater than 2; said second parallel digital signal is a second n-bit digital signal; said multi-level analog signal is a $2^n$-level analog signal; said third parallel digital signal is a third n-bit digital signal; and said fourth parallel digital signal is a fourth n-bit digital signal.

12. A signal transmission system as claimed in claim 9 in which said first converter means comprises subtractor means for providing a difference signal between said analog audio signal and a comparison signal, first analog-to-digital converter means for converting said difference signal into said first parallel digital signal, latch circuit means for latching said first parallel digital signal in synchronism with said first clock signal, and digital-to-analog converter means for converting the output of said latch circuit means into an analog signal and supplying the converted analog signal to said subtractor means as said comparison signal;

said second converter means comprises means responsive to said first clock signal for scrambling the output of said latch circuit means to provide said second parallel digital signal;

said level-discriminator means comprises second analog-to-digital converter means for converting said received multi-level analog signal into said third parallel digital signal in synchronism with said second clock signal; and said third converter means comprises means responsive to said second clock signal for descrambling said third parallel digital signal to provide said fourth parallel digital signal.

* * * * *

UNITED STATES PATENT AND TRADEMARK OFFICE
CERTIFICATE OF CORRECTION

PATENT NO. : 4,837,821

DATED : June 6, 1989

INVENTOR(S) : KOUZOU KAGE

It is certified that error appears in the above-identified patent and that said Letters Patent is hereby corrected as shown below:

Col. 1, line 61 delete "n-bit" and insert --n-bit--.

line 67, delete "n-bit" and insert --n-bit--.

Col. 2, line 6, after "analog" insert --audio--.

line 9, delete "n-bits" and insert --n-bits--.

line 52, delete "n-bit" and insert --n-bit--.

line 52, delete "n" and insert --n--.

line 53, delete "n-bit" and insert --n-bit--.

Col. 3, line 13, delete "n-bit" and insert --n-bit--.

line 31, delete "x'n" and insert --$x'_n$--.

line 57, delete "n" and insert --n--.

Col. 4, line 10, delete "n-bit" and insert --n-bit--.

line 11, delete "n-being" and insert --n-being--.

line 12, delete "n-bit" and insert --n-bit--.

lines 48, 50 and 51, delete "n's" and insert --n--.

UNITED STATES PATENT AND TRADEMARK OFFICE
CERTIFICATE OF CORRECTION

PATENT NO. : 4,837,821

DATED : June 6, 1989

INVENTOR(S) : KOUZOU KAGE

It is certified that error appears in the above-identified patent and that said Letters Patent is hereby corrected as shown below:

Col. 5, lines 26, 27, 29, delete "n's" and insert --n--.

Col. 6, lines 1 and 2, delete "n's" and insert --n--.

Signed and Sealed this

Thirteenth Day of March, 1990

*Attest:*

JEFFREY M. SAMUELS

*Attesting Officer*

*Acting Commissioner of Patents and Trademarks*